US009272224B2

(12) United States Patent
Nemeth et al.

(10) Patent No.: US 9,272,224 B2
(45) Date of Patent: Mar. 1, 2016

(54) AMUSEMENT PARK RIDE WITH CANTILEVERED RIDE VEHICLES

(71) Applicant: DISNEY ENTERPRISES, INC., Burbank, CA (US)

(72) Inventors: Edward A. Nemeth, Hermosa Beach, CA (US); Spencer T. Banks, Glendale, CA (US); Derek Howard, Pasadena, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 163 days.

(21) Appl. No.: 14/198,963

(22) Filed: Mar. 6, 2014

(65) Prior Publication Data

US 2015/0251101 A1 Sep. 10, 2015

(51) Int. Cl.
*A63G 21/00* (2006.01)
*A63G 21/08* (2006.01)

(52) U.S. Cl.
CPC ..... *A63G 21/08* (2013.01)

(58) Field of Classification Search
CPC ..... A63G 21/08
USPC ..... 104/53; 182/2.1, 2.11
See application file for complete search history.

(56) References Cited

U.S. PATENT DOCUMENTS 3,614,823 A * 10/1971 Weber et al. ..... B65G 15/00 198/827
4,326,601 A * 4/1982 Grove ..... B66F 17/006 116/298
4,347,791 A * 9/1982 Mandros ..... B60V 3/04 104/138.1
4,917,214 A * 4/1990 Mlaker ..... B66F 11/044 182/2.2
5,135,074 A * 8/1992 Hornagold ..... B66F 11/046 182/141
5,433,153 A * 7/1995 Yamada ..... A63G 7/00 104/241
5,453,053 A * 9/1995 Danta ..... A63G 7/00 280/791
5,473,990 A * 12/1995 Anderson ..... A63G 31/16 104/154
5,527,221 A * 6/1996 Brown ..... A63G 21/08 104/78
5,935,011 A * 8/1999 Morgan ..... A61G 3/061 414/462
6,269,749 B1 * 8/2001 Hogg ..... B61B 5/02 104/124
6,871,596 B2 * 3/2005 De-Gol ..... A63G 1/34 104/53
7,182,173 B2 * 2/2007 Bailey ..... B66C 23/36 182/2.1

(Continued)

OTHER PUBLICATIONS

"Nifty's rail mounted cherry picker", Nifty, Oct. 2, 2013, retrieved from http://www.niftylift.co.za/p=894.

*Primary Examiner* — Jason C Smith
(74) *Attorney, Agent, or Firm* — Mash Fischmann & Breyfogle LLP; Kent A. Lembke

(57) ABSTRACT

An amusement park ride adapted to provide passengers unobstructed lines of sight in turns and increased turn velocities. The ride includes a track and a ride vehicle. The ride vehicle includes a track connector assembly coupled to the track for movement along the ride path in a direction of travel. The vehicle also includes a vehicle base mounted to the track connector assembly to move with the track connector. The vehicle includes a bridge, or cantilever support arm or boom, extending from the vehicle base. The vehicle further includes a passenger compartment with one or more passenger seats. The passenger compartment is mounted to the bridge such that the seats and any passengers seated therein are spaced apart from the base at a cantilever distance. As a result, the passenger compartment has fore or aft cantilever mounting relative to the track connector assembly and relative to the vehicle base.

10 Claims, 8 Drawing Sheets

(56) References Cited

U.S. PATENT DOCUMENTS 7,437,998 B2 * 10/2008 Burger ..... A63G 3/00 104/23.1
7,685,944 B2 * 3/2010 Kilbert ..... A63G 21/08 104/53
8,453,579 B2 * 6/2013 Nemeth ..... A63G 3/00 104/53
8,622,170 B2 * 1/2014 Bean ..... B66F 11/046 182/18
8,960,097 B2 * 2/2015 Fritsche ..... B66B 21/10 104/53
9,079,756 B2 * 7/2015 Beji ..... B66F 11/046
2003/0173151 A1 * 9/2003 Bodtke ..... B66F 17/006 182/18
2004/0262078 A1 * 12/2004 Bailey ..... B66F 17/006 182/2.1
2011/0308058 A1 * 12/2011 Sperling ..... E01B 29/32 29/428
2011/0319178 A1 * 12/2011 Howard ..... A63G 21/08 472/43
2011/0319179 A1 * 12/2011 Howard ..... A63G 21/08 472/43
2015/0251101 A1 * 9/2015 Nemeth ..... A63G 21/08 104/53
2015/0251619 A1 * 9/2015 Sutherland ..... B60R 21/02 104/53

* cited by examiner

AMUSEMENT PARK RIDE WITH CANTILEVERED RIDE VEHICLES

BACKGROUND

1. Field of the Description

The present description relates, in general, to amusement park rides including roller coasters and other track-based rides, and, more particularly, to new ride vehicles that are specially designed to provide passengers with new and exciting ride experiences while riding on a track. In this way, new rides and passenger experiences can be provided with new or even existing track layouts.

2. Relevant Background

Amusement and theme parks are popular worldwide with hundreds of millions of people visiting the parks each year. Park operators continuously search for and research new designs for rides to continue to attract and entertain park visitors. The park operators recognize that their repeat visitor numbers will be lower and lower over the years without changes and upgrades to their rides.

Further, it is often important to build upon or modify existing rides to provide park visitors with new and exciting experiences without the cost or inconvenience of completely demolishing and replacing an existing ride with a wholly new ride. For example, it is much more desirable for a park operator to reuse an existing track and support structure than to remove these and build a completely new ride as this places a ride out of use for a longer period of time and, during construction, is more disruptive to nearby attractions.

In some cases, park operators will even try to retain ride vehicles without modification while providing a "new" show. For example, the theme of a ride may be changed to present sets and characters from a more recently released movie while the actual track and passenger vehicles remain unchanged. In this regard, experiences may also be changed by trying to provide additional interactivity or gaming to try to entertain the passengers.

However, the ride experience itself has remained unchanged as the passenger vehicles travel over the same track. The passengers soon become accustomed to and, sometimes, bored with the ride experience as the passengers begin to remember each corner and its turning sensations as well as each straightaway and each rise and fall along the track. The passengers' views or lines of sight also do not change as the passenger vehicle typically faces forward such that the passengers face or look along the direction of travel (DOT) of the vehicle.

SUMMARY

The present description teaches an amusement park ride that is specially configured to provide passengers with a new ride experience while retaining use (in most cases) of a conventional ride track to guide and support a ride vehicle along a ride path (along a direction of travel (DOT) defined by the ride track).

The inventors recognized that conventional track-based ride vehicles include a passenger compartment (or passenger-seating compartment or passenger cabin or other similar label) that is positioned or built over the vehicle's wheels (or other track connectors). As a result, the passengers in the passenger cabin or compartment travel along the track at the same speed as the wheeled part of the vehicle (e.g., the vehicle base or body). Also, the passenger cabin or compartment turns at the same rate or speed as the vehicle's wheeled base such that the passenger motion is determined by the track configuration, including the curves in the track, and not by features of the passenger cabin or compartment.

In addition to this limitation, a problem with existing ride vehicle designs in which the passenger compartment is over the base/body and wheels is that the passengers have a line of sight that is forward along the DOT of the ride vehicle into the back of a leading vehicle/car. This causes many passengers to have their views undesirably blocked so they have difficulty seeing ride sets and interactive components as their view is often blocked by other passengers' heads or seat backs. Hence, there is a need for providing passengers both with new ride experiences in the form of speed/rates of travel that differ from that of the vehicle's base/body (or an axis of rotation passing through this portion of the ride vehicle) and with improved viewing opportunities for the passengers and/or viewpoints that can change as the ride vehicle moves between straight track sections and curves in the track.

To address these and other problems with conventional track-based rides, the amusement park ride of the present description includes a track and ride vehicle (tracked ride vehicle) adapted for being supported upon and being guided by the track. The ride vehicle (which may be provided in a train, as an omnimover, or as a single vehicle) has a base (or body) to which a track connector assembly is attached to allow the vehicle to ride upon or underneath the track (e.g., a set of bogies or wheels mating with the track). Significantly, the ride vehicle further includes a passenger compartment that is cantilevered forward of (or rearward of) the bogey or wheeled base of the ride vehicle.

For example, the passenger compartment may be spaced apart from the base (and the track-engaging wheels or track connectors) by a cantilever support element (which may also be labeled a "bridge" or an "arm"). Functionally, the ride vehicle is hanging out in front (or behind) of the drive/coaster portion provided by the vehicle base. When the ride is operated to cause the ride vehicle to move along the track, the cantilevered arm will negotiate curves in the track with the same angular speed as the drive/coaster portion or the wheeled vehicle base. As a result, the passenger compartment will experience amplified lateral motion and speed as compared to a conventional ride vehicle with the passenger compartment on the wheeled base.

More particularly, an amusement park ride is provided that is adapted to provide passengers with a new ride experience including new lines of sight (e.g., unobstructed lines of sight even when in trailing vehicles) and increased turn velocities. To these and other ends, the ride includes a track defining a ride path such as a loop with a number of curves or turns. The ride includes a ride vehicle with: (a) a track connector assembly coupled to the track for movement along the ride path in a direction of travel; (b) a vehicle base mounted to the track connector assembly to move with the track connector assembly over or under the track; (c) a bridge (or cantilever support arm or boom) extending from the vehicle base; and (d) a passenger compartment with seats adapted for seating one or more passengers. The passenger compartment is mounted to the bridge such that the seats (and any passengers seated therein) are spaced apart from the base. In this way, at least a portion of the passenger compartment has cantilever mounting relative to the track connector assembly or the vehicle base.

In implementing the amusement park ride, the bridge may extend from a forward end of the vehicle base or from a rear end of the vehicle base, whereby the cantilever mounting is longitudinal relative to the direction of travel of the ride vehicle along the track. Hence, the cantilever mounting is adapted to provide fore or aft cantilever mounting of the passenger compartment such that the passenger compartment has a forward offset or a rearward offset, respectively, relative to the vehicle base and the direction of travel of the track connector assembly along the track.

The bridge may have a longitudinal axis (or an axis in a plane passing through the bridge). This longitudinal axis may be parallel to the base or track. In other cases, though, the bridge extends at a cantilever angle from the bridge that is not zero. For example, the cantilever angle may be in the range of 15 to 60 degrees (such as 30 to 45 degrees or the like) as measured between the longitudinal axis and a horizontal plane extending through the base.

The amount of cantilevering may be varied to implement the ride. In some cases, the cantilever mounting is configured so as to position the passenger compartment a cantilever distance of at least 6 feet from a rotation axis of the vehicle base. In such cases, the cantilever distance is measured between the rotation axis of the vehicle base and a proximate one of the seats in the passenger compartment. In other implementations of the ride, the cantilever mounting is configured to position the passenger compartment a cantilever distance of at least 6 feet from a proximate attachment point of the track connector assembly with the track (e.g., where a pinch drive mates with a sidewall of the track, where a front/rear set of bogies nearest to the passenger compartment couples with the track, or the like).

In either case, the track typically will include one or more curves/bends, and the cantilever mounting achieved with the bridge is such that the seats of the passenger compartments are extended a distance (one-to-many feet) away from a right or left side of the track (depending on the direction of the curve/bend/turn in the track) as the track connector assembly and the base travel through the curves along a direction of travel. In this manner, these outward extended passenger vehicles have both unobstructed views of the surrounding ride features (e.g., set components, interactive elements, and so on) and increased relative velocity and/or turn forces (when compared with a vehicle simply mounted over the base and track connector assembly that rides over/under/on the track).

DETAILED DESCRIPTION

The following description is generally directed to an amusement park ride that includes a track defining a path ride. The park ride further includes a ride vehicle with a base or body that is attached to and, in some cases, driven along the track with a connector mechanism, which may include wheels, bogies, and drives or the like. A new ride experience is achieved by the ride vehicle because the vehicle includes a passenger compartment (or cabin) that, instead of simply being positioned over the driven/rolling base, is supported upon the base/body so as to be cantilevered outward a distance from the base. This cantilevering may be provided in the fore or aft direction from the base, with "fore" and "aft" measured relative to the direction of travel (DOT) of the base and its connector mechanism along the ride path of the ride's track.

Figure 6:
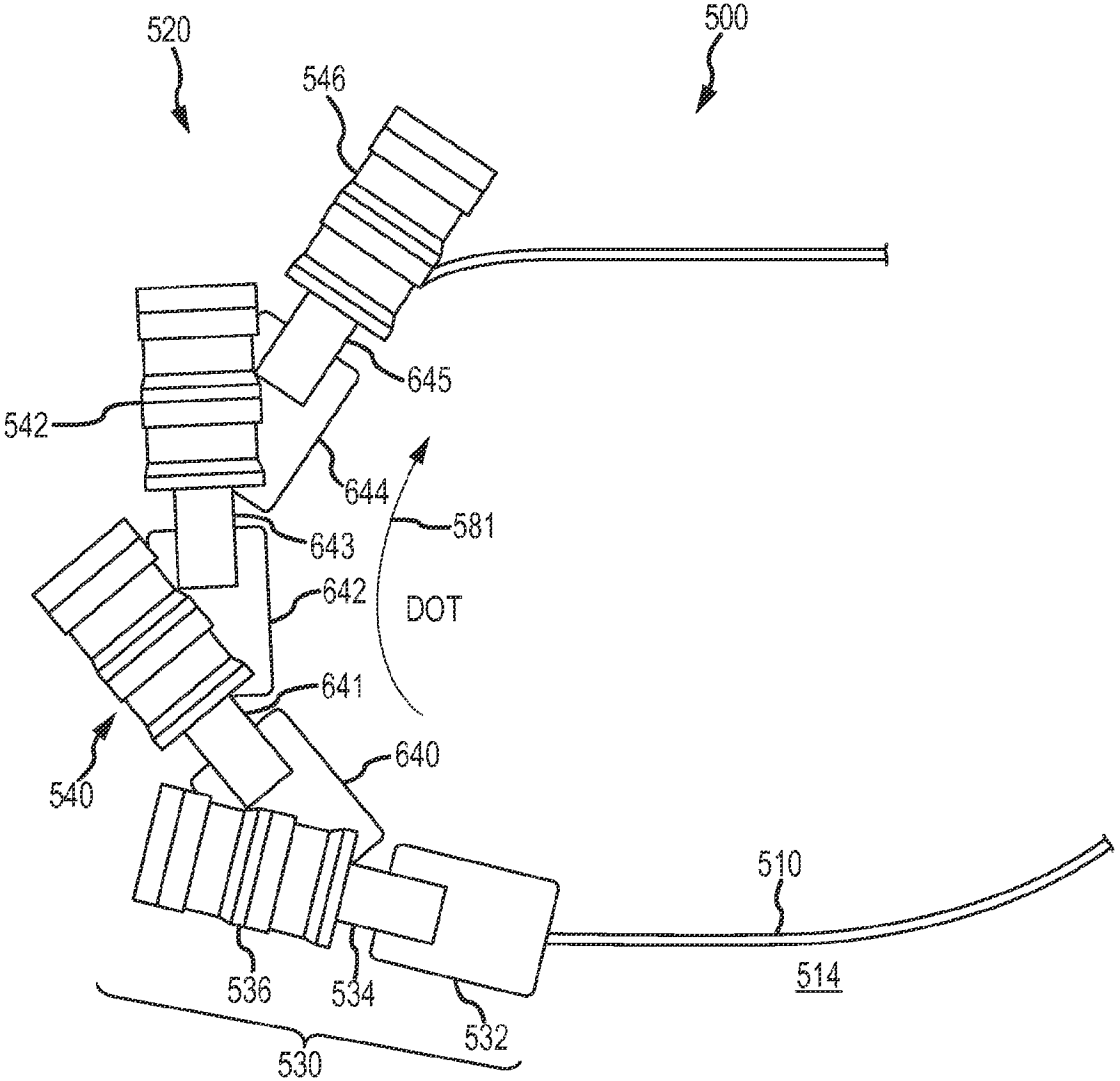

The ride vehicle may be a standalone vehicle or may be provided as part of a train of similar ride vehicles. The cantilevering of the passenger compartment provides the passengers in the train of vehicles unique views or lines of sight rather than simply looking at the back of the leading vehicle and its passengers (and having their views fully or partially blocked). For example, each cantilevered vehicle has a "lead vehicle-type view" as the train of cantilevered ride vehicles maneuvers a right or left hand turn in the track, e.g., see FIG. 6 showing all of the trailing vehicles facing outward as the train takes a right hand turn so as to allow the passengers to have unobstructed views of ride elements (such as a set, interactive characters or game elements, and the like).

Figure 1:
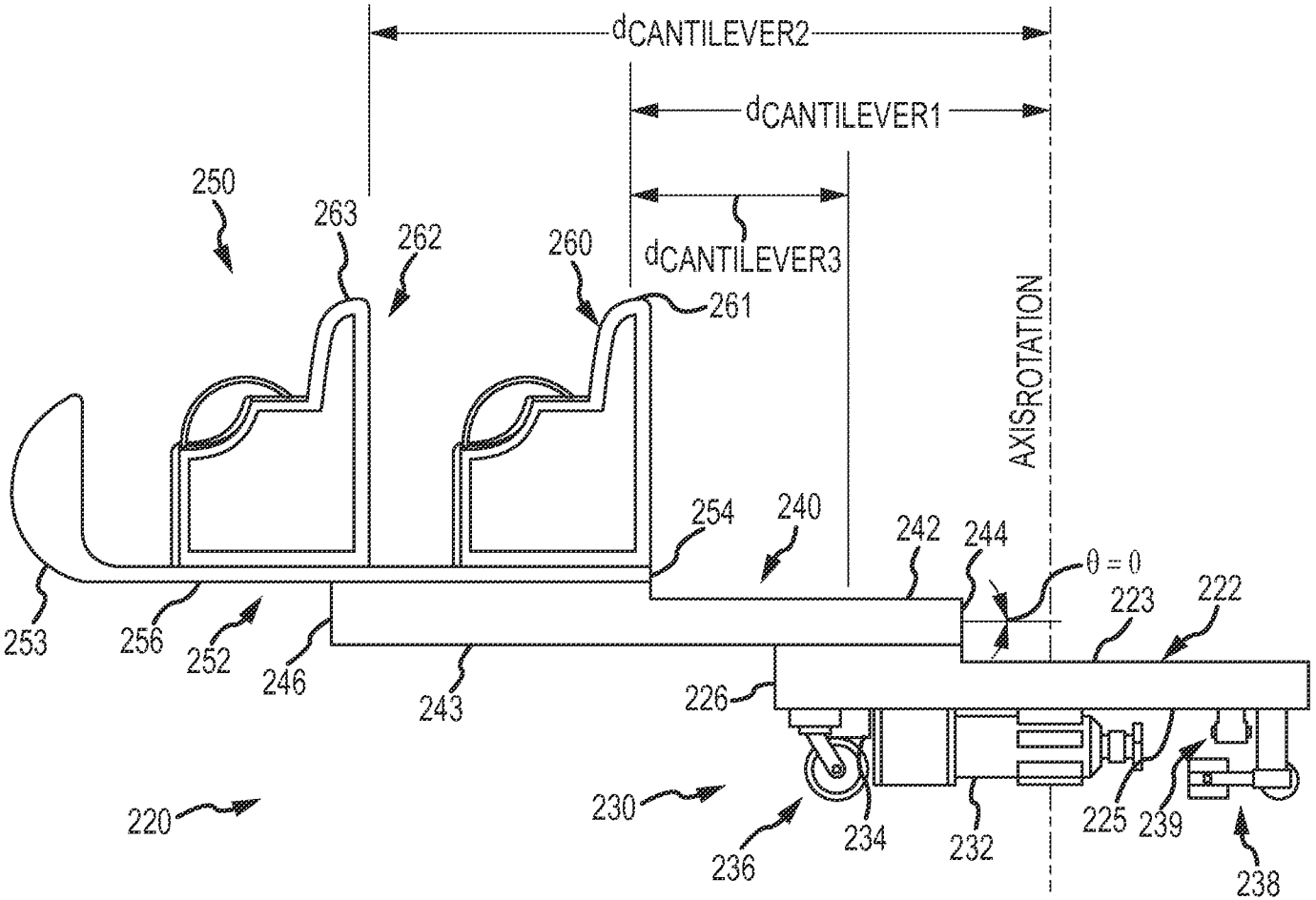
FIG. 1 is a side view of a ride vehicle, which may be used in the ride of FIG. 3, with a passenger compartment cantilevered from a fore or front end of a base (upon which a track connector assembly in the form of a pinch drive combined with a guide wheel(s) and an up stop wheel(s))
Figure 3:
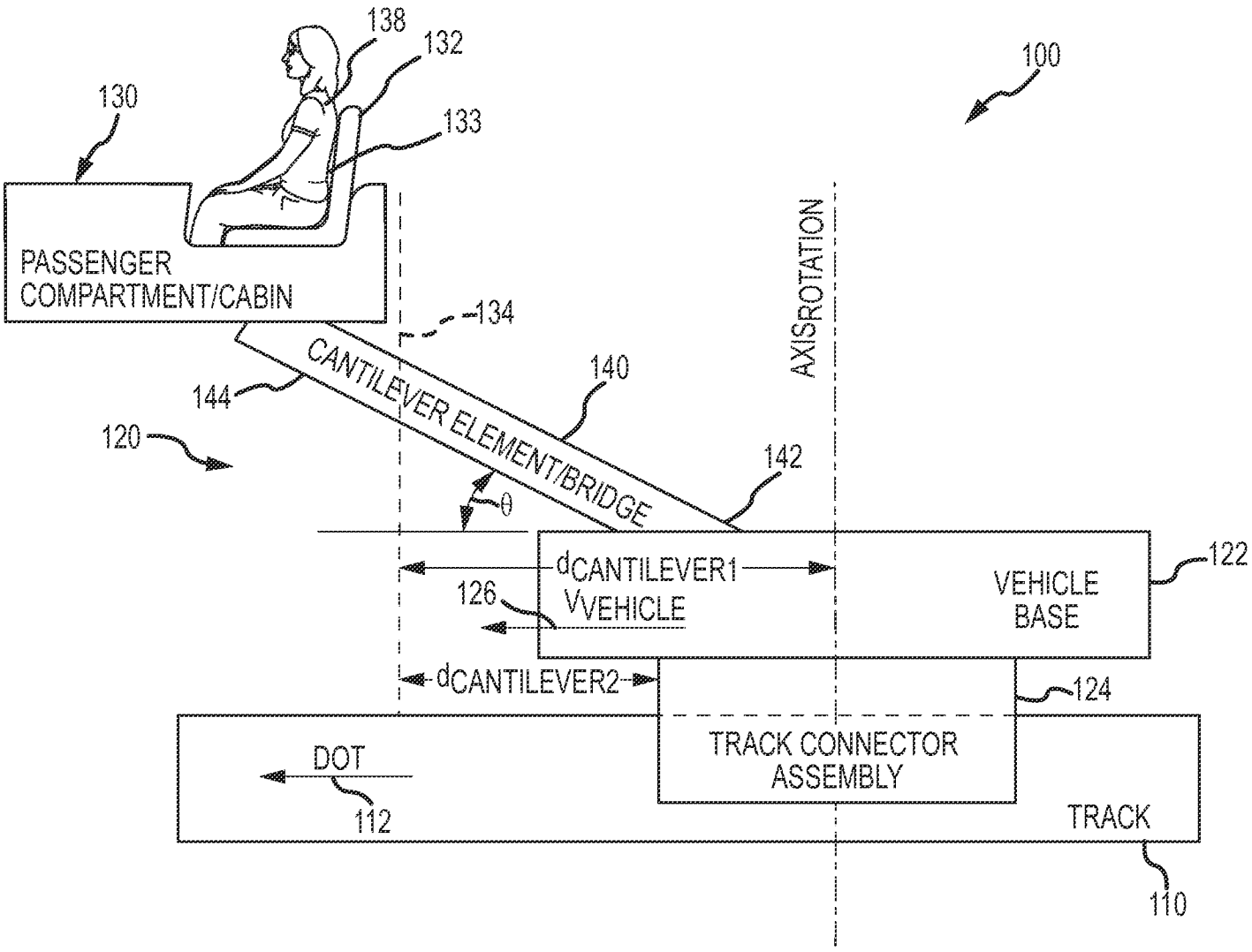
FIG. 3 is a functional block or schematic drawing that illustrates a portion of an amusement park ride or track-based ride to show a ride vehicle with a passenger compartment cantilevered from the base/body portion according to the present description.

With this brief overview in mind, FIG. 1 illustrates, with more detail, one implementation of a ride vehicle 220, which could be used in place of ride vehicle 120 in the ride 100 of FIG. 3. As shown, the ride vehicle 220 includes a planar (e.g., rectangular) base/body 222 with an upper surface 223 and a lower surface 225. A track connector assembly 230 is mounted to the lower surface 225, and the track connector assembly 230 is configured to rollably engage a ride track (not shown in FIG. 1 but can take the form of track 110 in FIG. 3). The track connector assembly 230 includes a pinch drive motor 232 that drives, such as with a belt or chain, a pinch drive 234 that engages the sidewalls of a track (or track section) and that is selectively operable to move the base/body 222 along a track in a desired DOT and at a desired speed(s).

The track connector assembly 230 also includes one or more load wheels 236 that may roll upon a ride platform or other surfaces adjacent to a track so as to support the base/body 222 (e.g., to provide stability and/or avoid side-to-side tipping). To further provide stability, the track connector assembly 230 may include one or more guide wheels 238 for engaging the track and guiding the base 222 to follow the track. One or more up stop wheels or guides 239 may also be provided to limit the amount of vertical travel of the base 222 relative to the track or track section engaged by the pinch drive 234 and guide wheel(s) 238.

Figure 2:
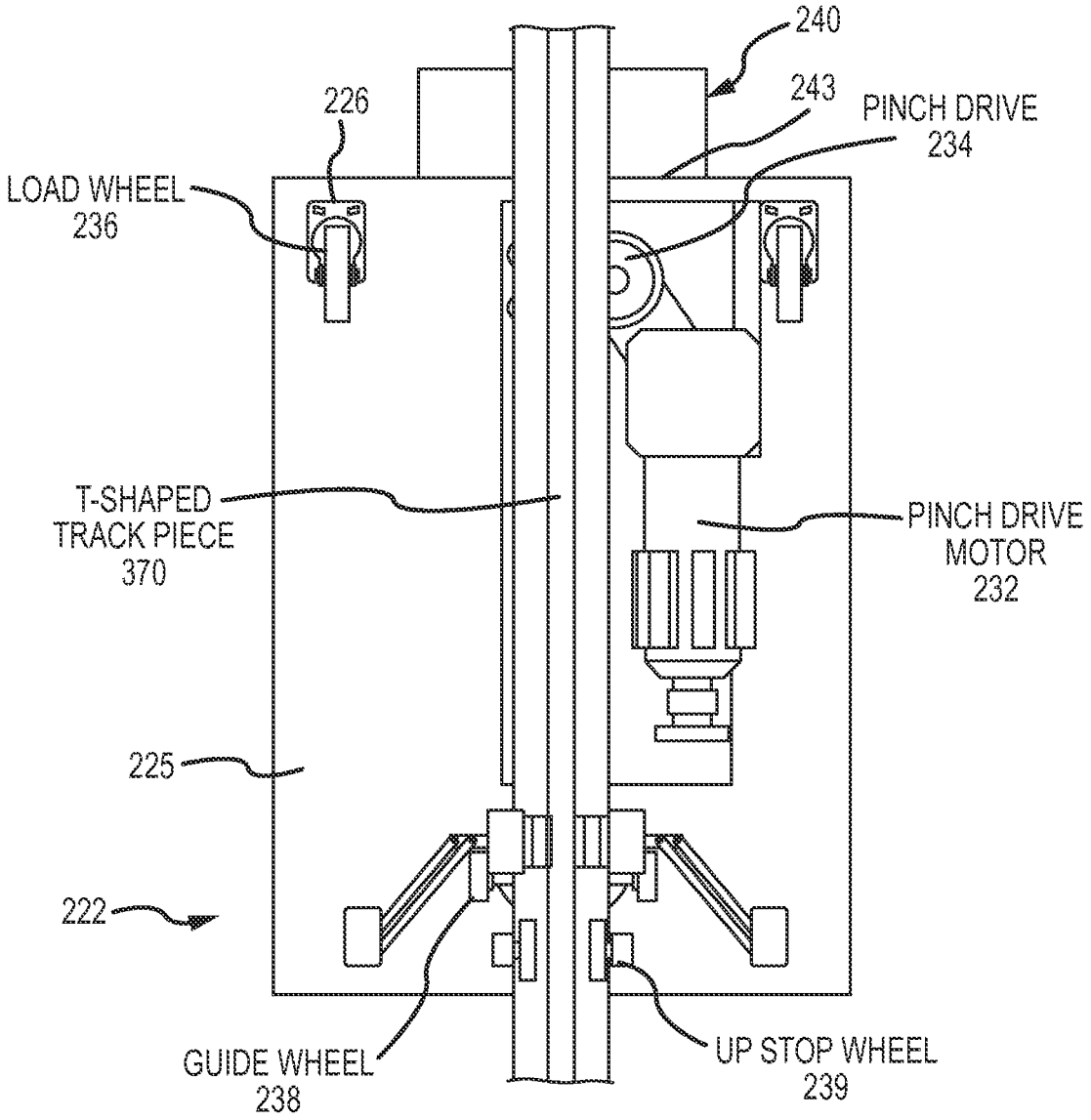
FIG. 2 illustrates the bottom side of the base of the ride vehicle of FIG. 1 with the base engaging a ride track.

FIG. 2 illustrates the ride vehicle 220 with a bottom view (or looking upward) of the base 222 and its lower surface 225 along with the components of the track connector assembly 230. A section of ride track 370 (e.g., a T-shaped track piece) is shown in FIG. 2 with the connector assembly 230 functioning to couple the base 222 to the track 370. As shown, the guide wheels 238 act to contact the vertical sidewalls of the track 370 to cause the base 222 to follow the ride path defined by the length of track 370. Also, the up stop wheel 239 is shown to contact or be proximate to the upper or horizontal portion (or "T") of the track 370. Further, the pinch drive 234 is shown to contact the sidewalls of the track 370 and when operated by the pinch drive motor 232 this forces the base 222 to move along the track 370 in a DOT at a particular velocity.

The ride vehicle 220 further includes a bridge or cantilever support arm/element 240, which is affixed to the upper surface 223 of the base 222 at a forward (or first) end 226. To this end, the bridge 240 has an upper surface 242 and a lower surface 243, and a rear (or first) end 244 of the bridge 240 is attached to the base 222 such as with lower surface 243 mated with the upper surface 223 of the base 222 at the end 226. The bridge 240 is shown to be arranged to be parallel to the plane of the base 222 (or to upper surface 223 of base 222) or, stated differently, the cantilever angle, θ, is zero degrees (or within several degrees of such a configuration).

The ride vehicle 220 further includes a passenger compartment or cabin 250. The compartment 250 includes a body or frame 252 extending from a first or front end 253 to a second or back end 254. The body/frame 252 has a lower surface or side 256, and the body/frame 252 is attached at the second/back end 254 to the bridge 240 such as with lower surface 256 mated with or abutting the upper surface 252 of the bridge 240 near its forward or second end 246. The passenger compartment or cabin 250 may be attached to the bridge 240 using a fixed connection (shown in FIG. 1) or with a rotating joint or a motion-capable joint (not shown in FIG. 1). The passenger compartment 250 includes a first (rear) seat/bench (or row of individual seats) 260 with a back support(s)/plane 261 and a second (forward) seat/bench (or row of individual seats) 262 with a back support(s)/plane 263. The seats 260, 262 are provided to receive and safely support one-to-many passengers in the compartment 250, and their design may vary with expected speeds and uses of the vehicle 220 (e.g., belting and other elements (not shown) may be provided and designed to suit planned speeds for the vehicle 220, banking of the track, vertical rises/drops, and the like).

The bridge 240 can said to be cantilevered in relation to the base 222 as it can be seen that a length of the bridge 240 extends outward from the end 226 of the base 222 (e.g., a length of the lower surface 243 of the bridge 240 is not directly in contact with or supported by the upper surface 223 of the base 222). Since the bridge 240 is a cantilevered beam or arm, the passenger compartment 250, which is positioned on the end 246 of the bridge 240 that is distal to the edge/end 226 of the base 222, is supported in a cantilevered manner relative to the base 222 in the ride vehicle 220.

The amount of cantilever may simply be stated as the amount of bridge 240 that is unsupported or a length of an exposed portion of lower surface 243, e.g., 1 to 15 feet or more. More typically, the amount of cantilever may be stated as the distance of the rear most bench/seat's back surface/plane 261 from either the base's rotation axis, $axis_{Rotation}$, as shown as $d_{cantilever1}$ (e.g., 5 to 10 feet or more) or the forward/proximate engaging portion of the connector 230 with the track (e.g., the rotation axis of the pinch drive 234) as shown as $d_{cantilever3}$ (e.g., 2 to 7 feet or more). In other cases, it may be useful to state a maximum amount of cantilever such as with a measurement from the most forward or most distal seats/benches 262 or their back supports 263 from the base 222 such as its rotation axis, $Axis_{Rotation}$, as shown as $d_{cantilever2}$ (e.g., 8 to 15 feet or more).

FIG. 3 illustrates with a functional block or schematic diagram of an amusement park ride 100 of the present description. FIG. 3 provides a partial view of the ride 100 with only a portion of a track 110 and a single ride vehicle (or ride vehicle assembly) 120 being shown for ease of explanation of the ride 100 with it being understood that a typical ride would include numerous vehicles 120 that may move independently (as shown) or be part of a train of such vehicles 120. The track 110 defines a ride path that typically would be a loop, which begins and ends in a station for loading and unloading of passengers, and the loop would include a plurality of right and/or left hand curves as well as straight lengths or sections ("straightaways"). The ride vehicle 120 typically will move along the track 110 in a direction of travel (DOT) as shown with arrow 112, e.g., a DOT may be chosen such the passengers 138 face in the direction which the vehicle 120 is moving along the track 110. The DOT as shown with arrow 112 is generally along the longitudinal axis of the track 110 or parallel to the track 110.

The ride 100 includes the ride vehicle 120 with a vehicle base (or body) 112 that is coupled to or supported upon the track 110 via a track connector assembly 124. The base 122 is shown to be supported above the track 110, but the ride 100 may also be implemented with a base 122 supported or hung below the track 110 (and with cantilevered passenger compartment 130 below the track 110). The vehicle base 122 may take a wide variety of forms as it generally acts as a support platform or chassis for the compartment/cabin 130 upon the track connector assembly 124. In some cases, the base 122 is provided as a simple planar frame while in others it takes a more complex form that may help to implement a ride theme or to disguise the existence of the connector assembly 124 and/or the track 110.

During operation of the ride 100, the base 122, and the passenger compartment 130 mounted onto the base 122, moves along the track 110 at a velocity, $V_{vehicle}$, as shown with arrow 126. To this end, the track connector assembly 124 may include bogies, wheels, or other components that allow the base 122 to roll along the track 110 while coupling the base 122 to the track 110 such that the base 122 does not lift off the track 122 (or fall from the track 122 when supported from above). The track connector assembly 124 may include bogies or similar components when the track 110 defines a gravity-based ride 100 such as a roller coaster. In some implementations of ride 100, the track connector assembly 124 may also include one or more drive mechanisms to cause the base 122 to move in the DOT shown by arrow 112 at the vehicle velocity, $V_{vehicle}$, shown by arrow 126. The particular coupling components, rolling/track engaging components, braking components, drive mechanisms, and the like provided in the track connector assembly 124 are not limiting to the ride 100 as nearly any arrangement may be used to implement the assembly 124 (e.g., any drive and wheel/bogie arrangement know (or to be developed) in the amusement park ride industry may be utilized).

In a conventional ride, a passenger compartment would be positioned directly upon the base 122. For example, the compartment could be centered upon the base 122 such that it rotates and moves with the base 122 as the base 122 moves along the DOT 112. This would include rotation about the base's axis of rotation, $Axis_{Rotation}$, which may extend through the base 122 and connector assembly 124 (such as through the center of the chassis of connector assembly or between fore and aft wheels/bogies in connector assembly 124).

In contrast, the ride 100 is adapted to provide a passenger 138 in a passenger compartment or cabin 130 a unique ride experience or at least a ride experience that differs from that provided to a passenger in a compartment mounted directly to the base 122. To this end, the passenger compartment 130 includes a seat/bench 132 with a back or back support 133, and a passenger 138 is positioned in the passenger compartment 130 upon the bench/seat 132 with their back/upper body supported by or against the back/support 133. The passenger compartment 130 is not mounted directly to the base 122 over the track connector assembly 124. Instead, the passenger compartment 130 is mounted in the ride vehicle 120 so as to be spaced apart a distance from the axis of rotation, $Axis_{Rotation}$, of the vehicle base 122 with cantilever mounting relative to the base 122 (or its upper or another mounting surface).

More specifically, the ride vehicle 120 includes a cantilever support element or bridge 140 that is used to mount the passenger compartment or cabin 130 to the vehicle base 122. The bridge 140 may take a wide variety of forms to act to space the compartment away from the base 122 (or provide cantilevered mounting) such as one or more linear (or non-linear) arms or beams. A first end 142 of the bridge 140 is affixed to the vehicle base 122, such as to the forward or rear portion of the upper surface of the base 122, while the compartment or its body 130 is affixed to a second end 144 of the bridge 140. The bridge 140 may be arranged at a cantilever angle, θ, that may range from 0 degrees (bridge 140 having its longitudinal axis parallel to a horizontal plane passing through the base 122 or to a longitudinal axis of the track 110) up to about 60 degrees (e.g., 30 to 45 degrees being useful in some elevated compartment embodiments of the ride 100).

The amount of cantilevering of the compartment 130 may also be varied to implement the ride 100 and may also be measured in a number of ways. For example, the amount of cantilever or cantilever distance (or compartment offset), ad, $d_{cantilever\ 1}$, may be measured as the distance between the rotation axis, $Axis_{Rotation}$, of the vehicle base 122 and a back support 133 of the passenger seat 132 (or location of the passenger or the rearmost or forwardmost passenger). In other cases, the cantilever distance, $d_{cantilever\ 2}$, may be measured as the distance between the back support 133 (or measured so as to coincided with a location of a passenger in the compartment 130) and a front edge or front axle (or wheel rotation axis) of the track connector assembly 124.

The cantilever amount or distance may be a relatively small amount such as 1 to 6 feet such as when the passenger compartment or cabin 130 is configured with one bench 132 or two to three seats 132 in a row. In other cases, though, the cantilever amount or distance is much larger such as 6 to 20 feet or more such as when the vehicle 120 is provided in a vehicle train and it is desirable to position a trailing vehicle compartment over a leading vehicle base (e.g., see FIGS. 5-10) or when there are two to six or more rows of seats 132 or benches 132 in the passenger compartment 130. In some cases, the amount of cantilever is chosen based on the size of the base 122 or the track connector assembly 124 such as to have a cantilever amount that is at least one half of the base 122 or connector assembly 125 length (as measured along the longitudinal axis of the track 110 or along the DOT 112).

The direction of the cantilevering provided by the bridge 140 is typically either in a forward direction or in a rearward direction (i.e., fore or aft cantilevering) relative to the base 122 (or the axis of rotation, $Axis_{Rotation}$). In FIG. 3, the ride 100 is shown to include ride vehicles 120 with fore cantilevering with the bridge 140 positioning the compartment 130 forward of the base 122 relative to the DOT 112, e.g., the compartment 130 travels ahead along the track 110 ahead of or leading the supporting but trailing vehicle base 122. This causes the compartment 120 to extend outward into space (not be directly above or below the track 110) when the vehicle 120 moves through curves in the track 110 (again, see FIGS. 5-10 for examples of this phenomenon). In other cases, the cantilevering would be aft cantilevering with the bridge 140 arranged to position the compartment 130 away from and behind the base 122 such that the compartment follows or trails the base 122 as it moves in the DOT 112 along the track 110.

The bridge 142 further is arranged to provide the cantilevering in a generally longitudinal manner, e.g., with the axis of the bridge/support arm 140 generally parallel to (e.g., a range of −15 to +15 degrees from) longitudinal axes of the base 122 and the track 110 (at least when measured in straight sections of the track 110) or parallel to the DOT 112 in a straight section of the track 110. In other words, the bridge 140 is not arranged on the base 122 so as to be orthogonal to the track 110 (e.g., when viewed from above).

Figure 4:
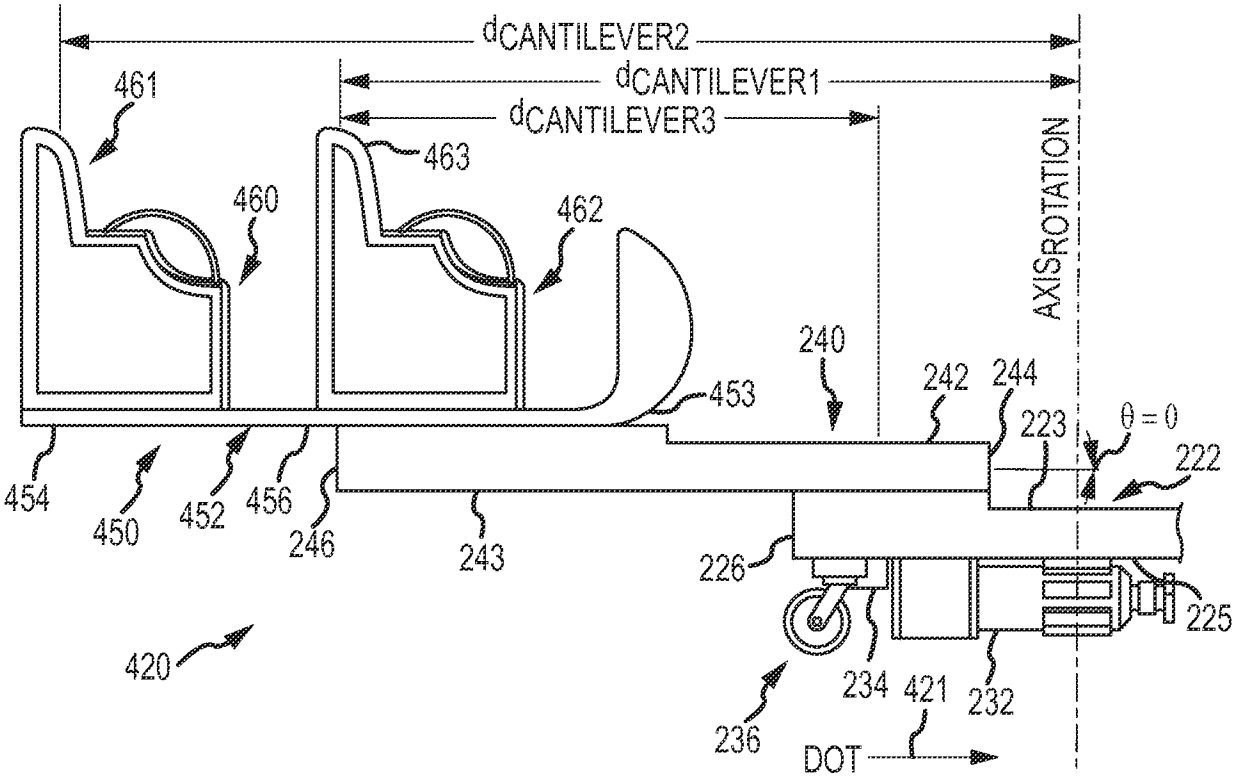
FIG. 4 is a view similar to that of FIG. 1 showing another ride vehicle of present description in which a passenger compartment cantilevered from an aft or rear end of the base upon which the track connector assembly is attached.

FIG. 1 shows a ride vehicle 220 with fore or forward cantilevering. In contrast, FIG. 4 shows a ride vehicle 420 with aft or rearward cantilevering. The ride vehicle 420 may be implemented with many of the same components as used in ride vehicle 220 including the base 222 and the cantilevered support arm or bridge 240. In fact, the bridge 240 may be mounted on the same end 226 of the base 222. However, the DOT as shown with arrow 421 for vehicle 420 is opposite that DOT of the vehicle 220 (which would have been to the left in the plane of the image shown in FIG. 1). In this way, a passenger compartment 450 in the ride vehicle 420 trails or follows behind the base 222 as the track connector assembly 230 is operated to move the ride vehicle 420 in the DOT 421, which provides a much different ride experience when compared with conventional ride vehicles and even when compared with the forward cantilevering in ride vehicle 220.

Particularly, the ride vehicle 420 includes a passenger compartment 450 mounted onto the upper surface 242 of the bridge 240 near the end 246, which is spaced apart from the end 226 of the base such that the bridge 240 is cantilevered relative to its support (i.e., the base 222). The passenger compartment 450 is arranged to allow passengers to face forward with the DOT 421 or towards the base 222 rather than away from the base 222 as shown in vehicle 220. The passenger compartment 450 is similar to compartment 250 in that it includes a first (rear) seat/bench (or row of individual seats) 460 with a back support(s)/plane 461 and a second (forward) seat/bench (or row of individual seats) 462 with a back support(s)/plane 463. The seats 460, 462 are provided to receive and safely support one-to-many passengers in the compartment 450, and their design may vary with expected speeds and uses of the vehicle 420 as discussed above.

As discussed above, the bridge 240 can said to be cantilevered in relation to the base 222 as it can be seen that a length of the bridge 240 extends outward from the end 226 of the base 222. Since the bridge 240 is a cantilevered beam or arm, the passenger compartment 450, which is positioned on the end 246 of the bridge 240 that is distal to the edge/end 226 of the base 222, is supported in a cantilevered manner relative to the base 222 in the ride vehicle 220. The amount of cantilever may be stated as the amount of bridge 240 that is unsupported or an exposed portion of lower surface 243, e.g., 1 to 15 feet or more. More typically, the amount of cantilever may be stated as the distance of the most forward bench/seat's back surface/plane 463 from either the base's rotation axis, $Axis_{Rotation}$, as shown as $d_{cantilever1}$ (e.g., 5 to 10 feet or more) or the forward/proximate engaging portion of the connector 230 with the track (e.g., the rotation axis of the pinch drive 234) as shown as $d_{cantilever3}$ (e.g., 2 to 7 feet or more). In other cases, it may be useful to state a maximum amount of cantilever such as with a measurement from the most rear or most distal seats/benches 460 or their back supports 261 from the base 222 such as its rotation axis, $Axis_{Rotation}$, as shown as $d_{cantilever2}$ (e.g., 8 to 15 feet or more).

With some exemplary cantilevered ride vehicles understood, it may be useful to describe operation of a ride that makes use of such vehicles in a train to obtain desirable and new ride experiences. FIGS. 5-9 illustrate an amusement park ride 500 with a top view or with an aerial view. As shown, the ride 500 includes a track 510 with a support or ride platform 514, and each ride vehicle, as discussed with reference to FIGS. 1-4, is adapted to couple and ride on the track 510 (such as with guide wheels and a pinch drive or the like) and to also be supported on upper/contact surfaces of the platform (such as with load wheels or the like).

Figure 5:
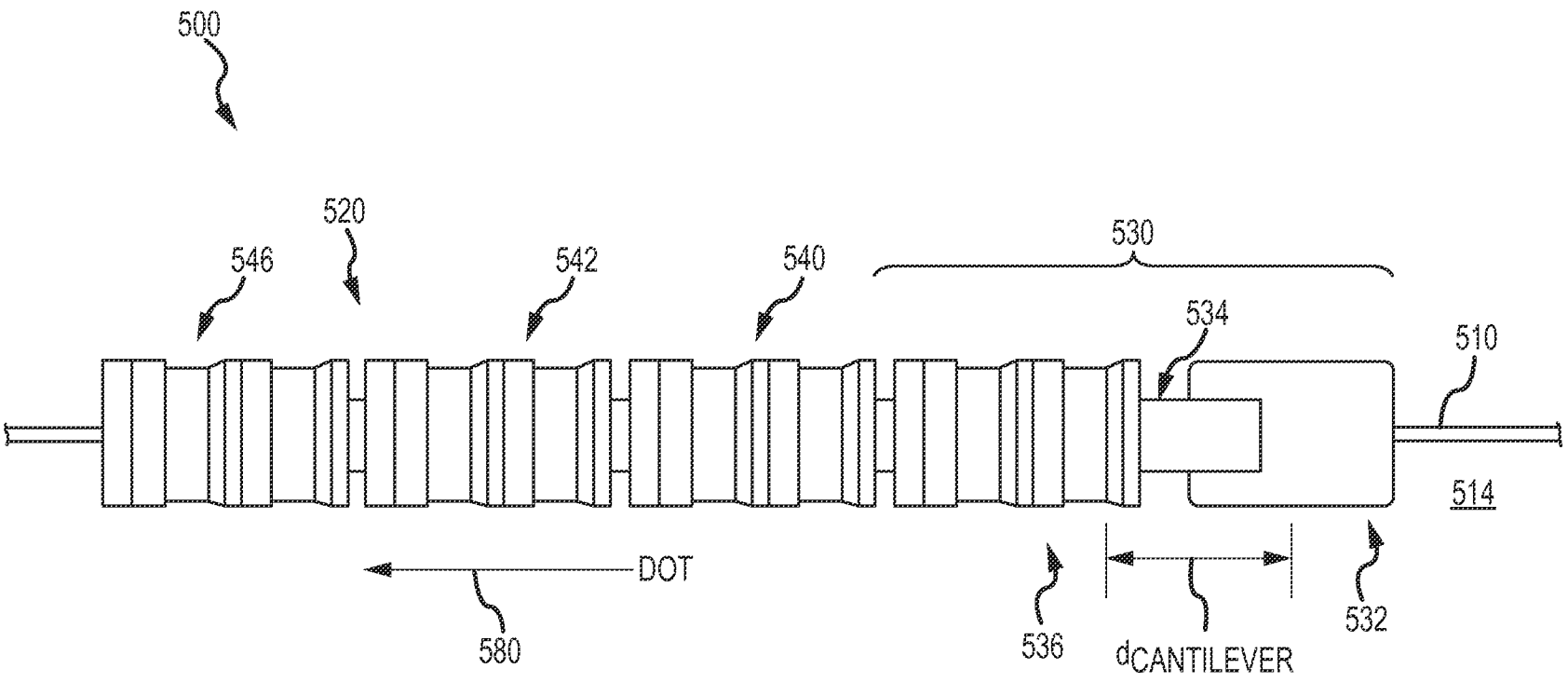
FIGS. 5-9 illustrate, in a simplified manner, an amusement park ride with sections of track, from above or from an aerial view, and with a train made up of exemplary ride vehicles with cantilevered passenger compartments (e.g., as shown in FIGS. 2 and 3) to show the train and its linked vehicles as they are moved through a series of curves in the sections of track to provide a new ride experience to passengers in the cantilevered passenger compartment.

The ride 500 further includes a vehicle train 520 made up of ride vehicle 530, ride vehicle 540, ride vehicle 542, and ride vehicle 546 that are interconnected to move in a DOT 580 as a unit. The vehicle 546 is the lead car in the train 520 with each of the other vehicles being trail cars/vehicles. In FIG. 5, vehicle 530 is shown to include a base/body 532 that, although not shown, includes a track connector (such as the assembly 124 or assembly 230) to couple with the track 510 (and, when useful, to drive the vehicle 530 on the track 510 in DOT 580).

The vehicle 530 also includes a passenger compartment 530 that is supported in a cantilevered manner from base 532 with the arm or bridge 534 that extends outward a distance from the base 532. The arm/bridge 534 has it longitudinal axis parallel to the longitudinal axis of the base 532 and, in the straight section of track 510 shown in FIG. 5, parallel to the track 510 and the DOT 580. The passenger compartment 536 typically is configured with its seats/benches arranged to cause seated passengers (not shown in FIG. 5) to face forward or in the DOT 580. Each of other vehicles 540, 542, 546 also includes a passenger compartment, a base coupled to the track 510, and a bridge/cantilever support arm such that their passenger compartments are also supported in a cantilevered manner relative to their bases/bodies.

As shown in FIG. 5, passenger compartments are cantilevered in an amount such that a trailing vehicle's passenger compartment is placed over the leading vehicle's base. In the straight section of track 510 shown in FIG. 5, each of the vehicles 530, 540, 542, 546 have their components including their passenger compartments aligned in a linear manner. The train 520, in other words, provides a ride experience similar to that of a conventional vehicle train in these sections with a leading passenger compartment being in the line of sight of a trailing vehicle, e.g., passengers in the compartment 536 of vehicle 530 have their light of sight along the DOT 580 block or partially obscured by passengers in the compartments (or by the compartments themselves) of vehicles 540, 542, 546.

However, as shown in FIG. 6, the use of cantilevered ride vehicles 530, 540, 542, 546 in the vehicle train 520 produces a much different result as the train 520 moves through non-straight or curved portions of the track 510. As shown, the train 520 is moving in a DOT 581 that is a fairly sharp right hand turn in the track 510, e.g., a 180-degree turn. With the cantilevered compartments, each compartment has an unobstructed view to the left or outside of the track 510. This can be seen with the trailing ride vehicle 530 having its passenger compartment 536 extending outward from the base 532 and also a distance from the track 510. Similarly, the next leading vehicle 540 has its compartment extending outward from a base 640 via cantilevered mounting with arm/bridge 641. Its view is not blocked by the vehicle 542. The vehicle 542 has it compartment extending outward from the track 510 with an unobstructed view, and the compartment is cantilevered via arm 643 extending outward a distance form base 642. Finally, vehicle 546 extends outward from the track 510 with its cantilevered mounting from base 644 via arm/bridge 645.

It can be seen that this produces a much different ride experience than if the passenger compartments were mounted over or on the bases in each vehicle 530, 540, 542, 546. The passengers not only obtain a different view but the feel or sensations of the ride differ as the cantilevering away from the rotation axis (fore or aft longitudinally along the DOT) of the base increases the velocity of the passengers (and corresponding forces applied to the passengers as the vehicles maneuver turns).

Figure 7:
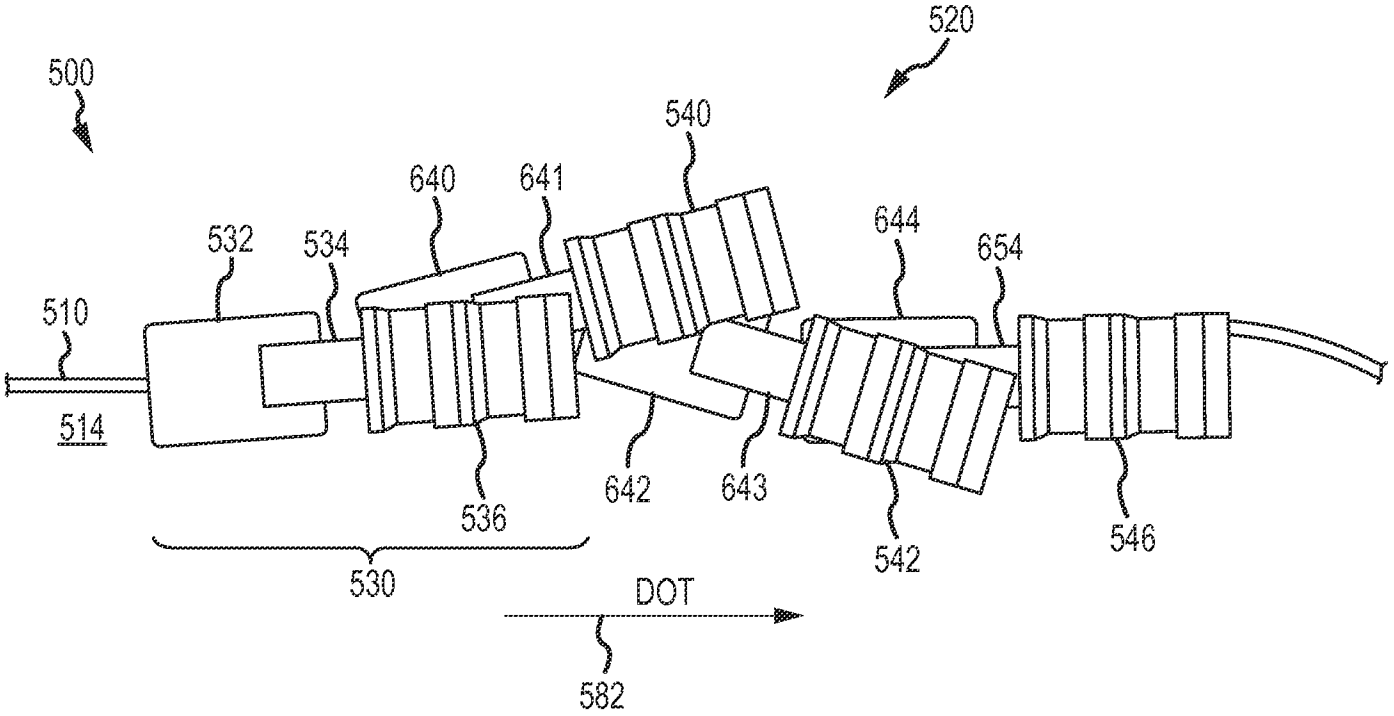

Instead of a full left or right hand turn, the track may include smaller turns back and forth or minor bends, and a train with cantilevered passenger compartments will provide passengers with a unique ride experience as these track sections are traveled with a DOT as shown with arrow 582. For example, FIG. 7 illustrates the vehicle train 520 as it travels through a section of the track 510 that includes a number of minor and opposite bends (e.g., one or more S-sections). The lead vehicle 546 is shown in its more conventional arrangement after the bends section of track with the passenger compartment and base 644 fully or mostly over the track 510. The last vehicle 530 is just entering the bends section of track 510 with the base 532 over the track 510 but passenger compartment beginning to move off or away from the track 510. The vehicle 540 leads vehicle 530 and is further along the bends section of track 510 and the base 640 is over the track 510 while the cantilevered compartment extend out from and/or away from the track 510 but from an opposite side relative to trailing vehicle 530.

The vehicle 542 has moved yet further along the track 510 and its passenger compartment extend away from the track 510 but in the opposite direction relative to its trailing vehicle 540. As can be seen, the use of cantilevered ride vehicles in the train 520 causes the passenger compartments magnify or amplify the turning of the bases of the vehicles in this section of the track 510. For example, base 642 of vehicle 542 shows where a convention passenger compartment would be relative to the track 510 while the passenger compartment of trailing vehicle 540 shows that cantilevering causes the compartment to be follow a ride path with exaggerated or larger movements in curves such as the bends in the section of track 510 shown in FIG. 7. The amount of magnification or amplification can be controlled by increasing or decreasing the amount of cantilever (or the cantilever distance) for the passenger compartments such as by increasing the length of the bridges/support arms.

Figure 9:
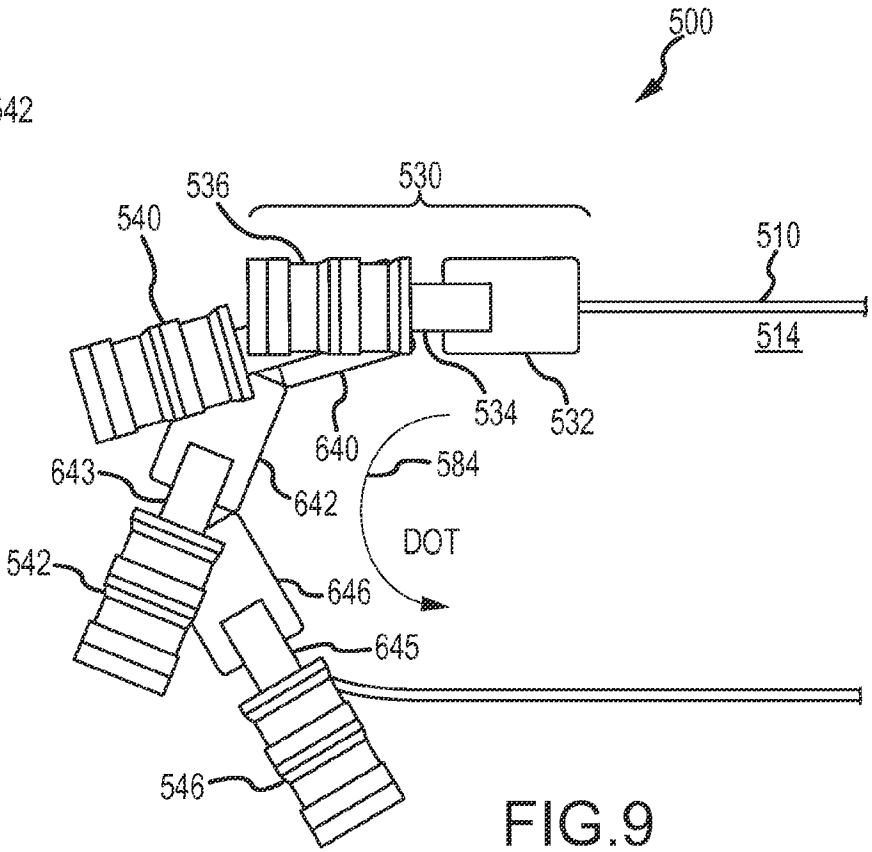
Figure 8:
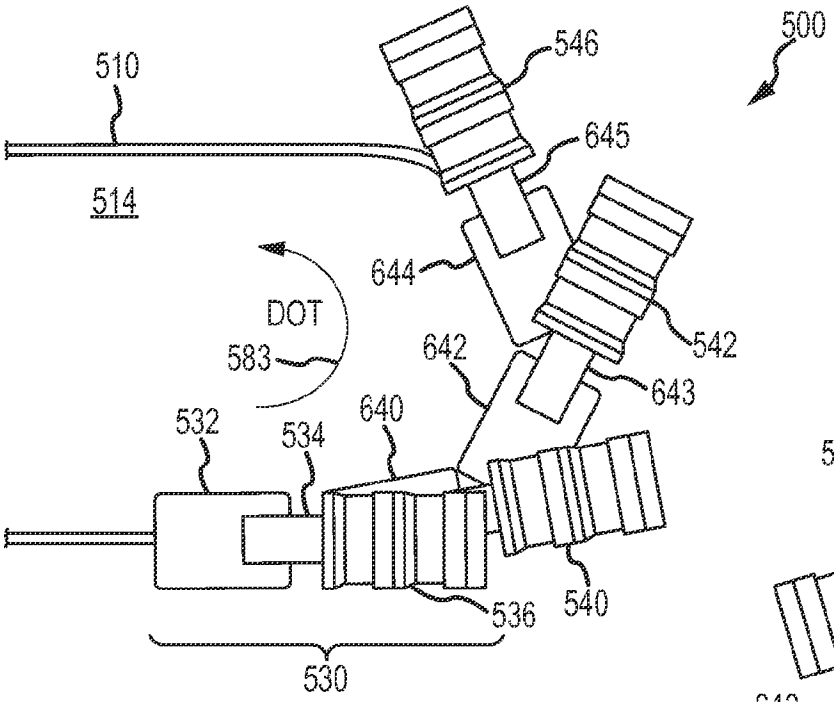

FIG. 8 illustrates the ride 500 when the vehicle train 520 is moving with DOT 583 through a left hand 180-degree turn or bend in track 510. The movement of the vehicles 530, 540, 542, and 546 are similar to those seen in FIG. 6 but a mirror image, e.g., with passenger compartments extending out from the right side of the track 510 rather than from the left side of the track 510. Again, though, each of the passenger compartments is offset from the track and also from the next or leading vehicle's base. FIG. 9 illustrates the ride 500 as the train 520 moves through a similar left hand 180-degree turn and moves in DOT 584.

A near miss experience is achieved when the track 510 of ride 500 is configured with the two 180-degree turns shown in FIGS. 8 and 9 placed nearby. In this way, the train passengers have their compartments extends outward from the track 510 and also toward an oncoming train with its passengers and passenger compartments. Such a "near miss" is achieved while the sections of track 510 remain relatively far apart as the extension or offsetting of the passenger compartments from the track causes or heightens the sense of impending collision or danger.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The cantilevered ride vehicles described herein provide a number of useful and significant advantages over prior ride vehicles. The ride vehicles are inexpensive to implement. The ride vehicles add new motion and visual possibilities for the passengers of tracked vehicle rides. In some cases, the vehicles provide dramatic lateral movement, and this movement of a preceding or leading vehicle in a train will provide passengers in the trailing vehicle new and interesting viewpoints, e.g., a preceding vehicle may suddenly swing out and away in a track curve opening up views for passengers in a next or trailing vehicle. In this regard, when all vehicles in a train are similarly cantilevered (which is not a requirement as some embodiments will have vehicles with differing amounts or types (angled or non-angled) cantilevering), every vehicle moving along a track will have the same visuals as the first vehicle in a train.

In embodiments using reversed or rearward cantilevered passenger compartments, the cantilever of the passenger vehicle relative to the wheeled base/body gives a drift effect that is a new ride experience not presently available in track-based amusement park rides. In general, the amusement park rides described herein teach ride vehicles with the passenger compartment or cabin longitudinally offset from the base/body of the vehicle such as may be measured from a base's rotation axis passing through or near the track connector(s) or from a front axle or a rear axle of a wheeled/bogied vehicle base.

We claim:

1. An amusement park ride, comprising:

a structural track defining a ride path with a plurality of curves; and a plurality of ride vehicles linked together into a train, wherein each of the ride vehicles comprises:

a track connector assembly rollably engaging the structural track;

a vehicle base mounted to the track connector assembly;

a cantilever support arm extending from a fore or aft end of the vehicle base; and a passenger compartment for receiving passengers, wherein the passenger compartment is mounted to an end of the cantilever support arm that is distal and spaced apart a cantilever distance from a rotation axis of the vehicle base, wherein the cantilever support arm of each trailing ones of the ride vehicles in the train extends a distance from a corresponding one of the bases to at least partially overlap with a leading one of the ride vehicles.

2. The ride of claim 1, wherein the cantilever distance is measured between a passenger seat in the passenger compartment that is proximate to the vehicle base and wherein the cantilever distance is at least 3 feet.

3. The ride of claim 1, wherein the cantilever distance is selected such that a portion of the passenger compartment containing seats for the received passengers extends outward from the structural track when the corresponding one of the ride vehicles travels through one of the curves.

4. The ride of claim 3, wherein one of the ride vehicles, leading the corresponding one of the ride vehicles, has a portion of the passenger compartment containing seats for the received passengers concurrently extending outward from the structural track in a different direction, whereby the two portions of the passenger compartments have lines of sight unobstructed by other ones of the passenger compartments.

5. The ride of claim 1, wherein the cantilever support arm extends outward from the vehicle base at a cantilever angle of 15 to 60 degrees.

6. An amusement park ride, comprising:

a structural track defining a ride path with a plurality of curves; and a plurality of ride vehicles linked together into a train, wherein each of the ride vehicles comprises:

a track connector assembly rollably engaging the structural track;

a vehicle base mounted to the track connector assembly;

a cantilever support arm extending from a fore or aft end of the vehicle base; and a passenger compartment for receiving passengers, wherein the passenger compartment is mounted to an end of the cantilever support arm that is distal and spaced apart a cantilever distance from a rotation axis of the vehicle base, wherein the cantilever support arm of each leading ones of the ride vehicles in the train extends a distance from a corresponding one of the bases to at least partially overlap with a trailing one of the ride vehicles.

7. The ride of claim 6, wherein the cantilever distance is measured between a passenger seat in the passenger compartment that is proximate to the vehicle base and wherein the cantilever distance is at least 3 feet.

8. The ride of claim 6, wherein the cantilever distance is selected such that a portion of the passenger compartment containing seats for the received passengers extends outward from the structural track when the corresponding one of the ride vehicles travels through one of the curves.

9. The ride of claim 8, wherein one of the ride vehicles, leading the corresponding one of the ride vehicles, has a portion of the passenger compartment containing seats for the received passengers concurrently extending outward from the structural track in a different direction, whereby the two portions of the passenger compartments have lines of sight unobstructed by other ones of the passenger compartments.

10. The ride of claim 6, wherein the cantilever support arm extends outward from the vehicle base at a cantilever angle of 15 to 60 degrees.

* * * * *